United States Patent [19]

Kurio

[11] 4,138,124

[45] Feb. 6, 1979

[54] CORNER SEAL FOR ROTARY PISTON ENGINES

[75] Inventor: Niroyuki Kurio, Higashihiroshima, Japan

[73] Assignee: Toyo Kogyo Co., Ltd., Hiroshima, Japan

[21] Appl. No.: 833,957

[22] Filed: Sep. 16, 1977

[30] Foreign Application Priority Data

Sep. 20, 1976 [JP] Japan ..... 51-113460

[51] Int. Cl.[2] ..... F01C 19/00; F03C 3/00; F04C 27/00; F16J 15/16

[52] U.S. Cl. ..... 277/81 P; 418/123; 418/124; 418/142; 418/144

[58] Field of Search ..... 277/81 P; 418/140, 142, 418/143, 144, 122–124

[56] References Cited

U.S. PATENT DOCUMENTS

| | | | |
|---|---|---|---|
| 3,180,560 | 4/1965 | Paschke | 418/61 A |
| 3,674,384 | 7/1972 | Larrinaga et al. | 418/142 X |
| 3,773,442 | 11/1973 | Mitchell et al. | 418/142 |
| 3,830,600 | 8/1974 | Shimoji et al. | 418/142 X |
| 3,930,767 | 1/1976 | Hart | 418/142 X |
| 3,961,871 | 6/1976 | Kurio | 418/123 X |

FOREIGN PATENT DOCUMENTS

| | | | |
|---|---|---|---|
| 1151413 | 7/1963 | Fed. Rep. of Germany | 418/124 |
| 2060715 | 6/1972 | Fed. Rep. of Germany | 277/81 P |
| 2128355 | 12/1972 | Fed. Rep. of Germany | 277/81 P |
| 2222327 | 11/1973 | Fed. Rep. of Germany | 418/144 |

*Primary Examiner*—Robert S. Ward, Jr.
*Attorney, Agent, or Firm*—Fleit & Jacobson

[57] ABSTRACT

Corner seal for rotary piston engines comprising a substantially cylindrical body which is formed with a groove for accommodating an end of the apex seal. The corner seal has an end surface adapted to be brought into a slidable engagement with the inner surface of a side housing. The end surface of the corner seal is formed with a recess so that the area of the sliding surface is decreased to 45 to 75% of a sum of the area of the sliding surface and the area of the recess.

3 Claims, 10 Drawing Figures

CRITICAL AREA RATIO a ----45 % e ----65 %
b ----50 % f ----70 %
c ----55 % g ----75 %
d ----60 % h ----78 %

| ENGINE SPEED r.p.m. | 1000 | | 1500 | | 2000 | |
|---|---|---|---|---|---|---|
| MEAN EFFECTIVE PRESSURE Kg/Cm2 | 1.5 | 5.5 | 1.5 | 5.5 | 1.5 | 6.5 |

CORNER SEAL FOR ROTARY PISTON ENGINES

The present invention relates to rotary piston engines and more particularly to corner seals therefor.

Conventional rotary piston engine comprises a casing which includes a rotor housing having an inner wall of trochoidal configuration and a pair of side housings secured to the opposite sides of the rotor housing, and a rotor of substantially polygonal configuration disposed in said casing for rotation with apex portions in sliding contact with the inner wall of the rotor housing. In order to provide gas-tight seal between each apex portion of the rotor and the inner wall of the rotor housing, the rotor is provided at each apex portion with an apex seal which is usually received in a groove provided for the purpose in the rotor. Further, the rotor is provided at each side surface with side seals which extend between respective two of the apex seals for sliding contact with the inner side surface of the adjacent side housing. At the junction of each apex seal and the adjacent side seals, there is provided a corner seal which is of a cylindrical configuration having an axially extending groove for receiving an adjacent end of the apex seal. The corner seal is usually received in a recess formed in the rotor for the purpose and the corner seals are so arranged that they abut the cylindrical outer surface of the corner seal. In use, the corner seal is subjected to the pressure of gas which may be allowed to leak from the working chambers into the recess, so that it is biased into sliding contact with the inner side surface of the adjacent side housing. Additionally a back-up spring may be provided in the recess for further biasing the corner seal toward the side seal.

Conventional corner seal has a plain outer end surface for such sliding contact with the inner surface of the side housing, however, since the gas pressure in the recess is quite high, there is produced a substantial frictional force between the outer end surface of the corner seal and the inner surface of the side housing. Such frictional force is considered as being a cause of increase in fuel consumption.

In order to eliminate the above problem, a proposal has been made by German patent Offenlegungsschrift No. 20 60 715, published June 29, 1972 to provide a recess in the outer end surface of the corner seal. In this arrangement, gas is also allowed to leak into the recess in the corner seal so that the corner seal is applied with a pressure which acts to moderate the biasing force on the corner seal. It has been found, however, that even with this arrangement satisfactory results cannot always be obtained. For example, in some cases the frictional resistance cannot be decreased to such an extent that a noticeable improvement in fuel consumption is obtained and in some other cases the side housings are stored through the sliding contact with the corner seals.

The present invention has therefore an object to provide a corner seal for rotary piston engines which does not produce any significant frictional force and is not harmful to the side housing.

Another object of the present invention is to provide a corner seal for rotary piston engines which provides an improvement in respect to fuel consumption but does not produce harmful scores on the side housing.

According to the present invention, the above and other objects can be accomplished by a rotary piston engine comprising a casing having an inner peripheral wall and a pair of inner side walls, and a rotor disposed in said casing and having apex portions adapted to be slidably engaged with said inner peripheral wall of the casing, said rotor having a pair of side surfaces opposing to said inner side walls of the casing, said rotor having recesses in the vicinity of the apex portions in each of the side surfaces, a corner seal received in each of the recesses and having an outer end adapted to be brought into sliding contact with the inner side wall of the casing at least under the influence of gas pressure introduced into said recess, said corner seal being formed at the outer end with a second recess leaving a sliding end surface on said outer end of the corner seal, said sliding end surface having an area between 45 and 75% of a sum of the area of the sliding surface and the area of the second recess, means being provided for introducing gas pressure into the second recess.

In a preferable mode of the present invention, the corner seal has a cylindrical configuration and the recess in the corner seal is located in co-axial relationship with the outer periphery of the corner seal. The means introducing gas pressure into the second recess may be constituted by a groove for receiving an end of in apex seal which may be provided along each apex portion of the rotor. The radial dimension of the sliding surface on the corner seal should preferably be not smaller than 1.0 mm and more preferably should be greater than 1.2 mm. The second recess in the corner seal may be located eccentrically with respect to the periphery of the corner seal. In the case where the radial dimension of the sliding surface is partially decreased due to the existence of, for example, an axial bore in the corner seal, the minimum radial dimension of the sliding surface may be as small as 0.8 mm, provided that the maximum radial dimension is greater than 1.2 mm.

The ratio of the area of the sliding surface to the sum of the area of the sliding surface and the area of the second recess may be referred to as a critical area ratio and is important because with the ratio greater than 75% an adequate improvement will not be attained. Where the ratio is smaller than 45%, the area of the sliding surface becomes so small that the co-operating inner side wall on the casing may be scored due to an increased pressure per unit area of the sliding surface. In the aforementioned arrangement where the second recess is co-axial with the periphery of the corner seal, the inner side wall may also be scored if the radial dimension of the sliding surface is smaller than 1.0 mm. In the eccentric arrangement, however, scoring can be substantially avoided even when the radial dimension of the sliding surface is as small as 0.8 mm, provided that the maximum dimension is greater than 1.2 mm.

The above and other objects and features of the present invention will become apparent from the following descriptions of preferable embodiments taking reference to the accompanying drawings, in which.

Figure 1:
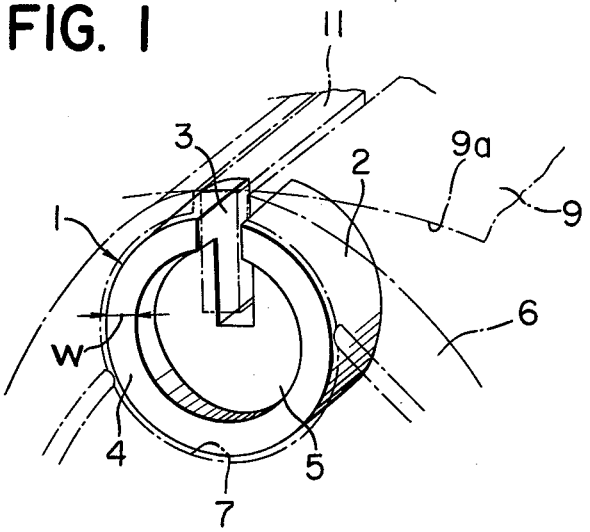
FIG. 1 is a fragmentary perspective view of a corner seal in accordance with an embodiment of the present invention with the rotor and apex seal shown in phantom lines.
Figure 6:
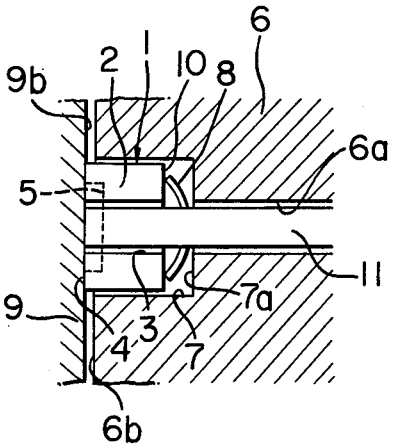
FIG. 6 is a fragmentary sectional view of a rotary piston engine equipped with the corner seal in accordance with the present invention.
Figure 7:
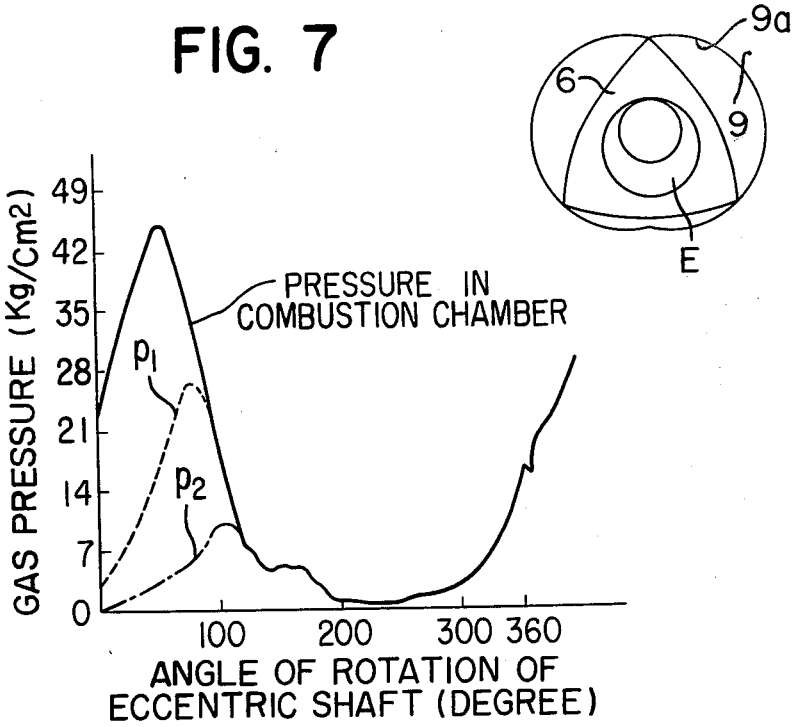
FIG. 7 is a diagram showing the gas pressure produced in a working chamber and the gas pressures which act on the corner seal.

Referring now to the drawings, particularly to FIG. 1, there is shown a corner seal 1 embodying the features of the present invention. The corner seal has a cylindrical peripheral surface 2 and an axially extending groove 3 for receiving an apex seal. Referring further to FIG. 1 together with FIG. 6, the rotary piston engine comprises a casing 9 which has an inner peripheral wall 9*a* and inner side walls 9*b*, one of which is shown in FIG. 6. In the casing, there is disposed a substantially triangular rotor 6 having apex portions each of which is formed with a seal groove 6*a* for receiving an apex seal 11. The rotor 6 also has a pair of side surfaces 6*b*, each of which is formed at each apex portion with a cylindrical recess 7 for receiving the aforementioned corner seal 1. As shown in the drawings, each end of the apex seal 11 is received in the groove 3 of a corner seal 1. In the recess 7, there may be disposed a back-up spring 8 which acts between the bottom 7*a* of the recess 7 and the inner end 10 of the corner seal 1. At the outer end, the corner seal is formed with a circular recess 5 which thus defines an annular sliding surface 4 having a radial dimension W. Referring to FIG. 7, there is shown the gas pressure in a combustion chamber as measured under the test condition of wide throttle opening with the engine speed of 2000 rpm and the mean effective pressure 8 Kg/cm2. The change in the gas pressure is shown with respect to the angle of rotation of the eccentric shaft E from the compression top dead center. As shown in FIG. 7, the gas pressure in the combustion chamber takes the maximum value of approximately 45 Kg/cm$^2$ at the angle of rotation of the eccentric shaft E of about 50°. The gas pressure is allowed to leak into the recess 7 and serves to force the corner seal 1 against the inner side surface 9*b* of the casing 9. The pressure in the recess 7 is shown by P1 in FIG. 7 and has a peak value of approximately 26 Kg/cm$^2$. The pressure is further allowed to leak through the gap between the apex seal 11 and the seal groove 3 of the corner seal 1 into the recess 5. The pressure in the recess 5 is shown by P2 in FIG. 7 and has a peak value of approximately 10 Kg/cm$^2$.

The pressure in the recess 5 serves to moderate the biasing force of the pressure in the recess 7 resulting in a decrease in the frictional force which may be produced between the sliding surface 4 and the inner side surface 9*b* of the casing 9. However, when the area of contact between the corner seal 1 and the inner side wall 9*b* of the casing 9 is decreased in accordance with an increase in the area of the recess 5 in the corner seal 1, there is a corresponding increase in the contact pressure per unit area of the sliding surface 4 even though the biasing force on the corner seal against the inner side wall 9*b* of the casing 9 is moderated by the pressure in the end recess 5. Such increase in the contact pressure may possibly cause scoring on the inner side wall 9*b* of the casing 9. Therefore, there is a limit in the area of the end recess 5 in the corner seal 1. On the other hand, if the area of the recess 5 is too small, an adequate effect will not be obtained for moderating the biasing force on the corner seal 1.

Figure 2:
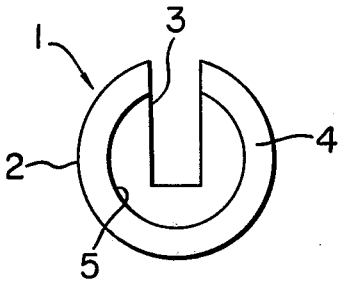
FIG. 2 is a front view of a corner seal having a co-axial end recess with the critical area ratio of 45%.
Figure 3:
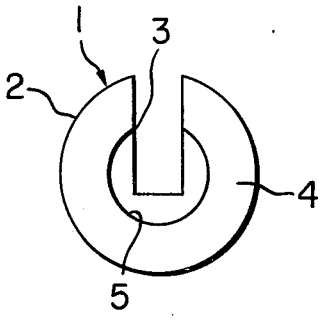
FIG. 3 is a front view similar to FIG. 2 but showing a corner seal having the critical area ratio of 75%.

According to the present invention, the ratio of the area of the sliding surface 4 to the sum of the area of the sliding surface 4 and the effective pressure acting area of the recess 5 is between 45 and 75%. The ratio may be referred to as the critical area ratio. Further, the radial dimension W of the sliding surface 4 should be 1.0 mm or greater and preferably greater than 1.2 mm. FIG. 2 shows an example of a corner seal having the critical area ratio of 45%. FIG. 3 shows another example wherein the critical area ratio is 75%.

Figure 4:
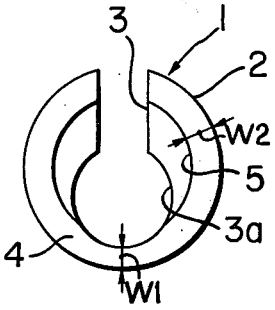
FIG. 4 is a front view of a corner seal in accordance with another embodiment of the present invention.

In FIG. 4, there is shown a further embodiment of the corner seal which has an axial bore 3*a* contiguous with the seal groove 3. In this embodiment, the radial dimension of the sliding surface 4 is decreased in part as shown by W1 as compared with the dimension W2 due to the existence of the offset axial bore 3*a*. In this case, the smallest dimension W1 may be as small as 0.8 mm provided that the larger dimension W2 is not less than 1.2 mm. In the particular case shown in FIG. 4, the dimensions W1 and W2 are 0.8 mm and 1.2 mm respectively, and the critical area ratio is about 55%. The outer diameter of the seal 1 is 5.5 mm and the diameter of the bore 3*a* is 3.0 mm. In the embodiment, the amount of offset of the axial bore 3*a* may be decreased so that the bore 3*a* is inscribed within the recess 5. The critical area ratio will then be about 60%.

Figure 5:
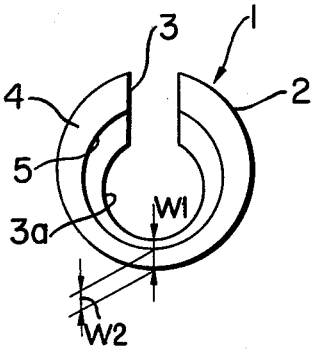
FIG. 5 is a front view showing a further embodiment of the present invention.

FIG. 5 shows a further embodiment in which the recess 5 and the axial bore 3*a* are both offset with respect to the outer surface 2. In the particular case, the minimum wall thickness W1 of the seal 1 is 1.2 mm while the minimum radial dimension W2 is 1.0 mm. The critical area ratio is approximately 70%.

Figure 8:
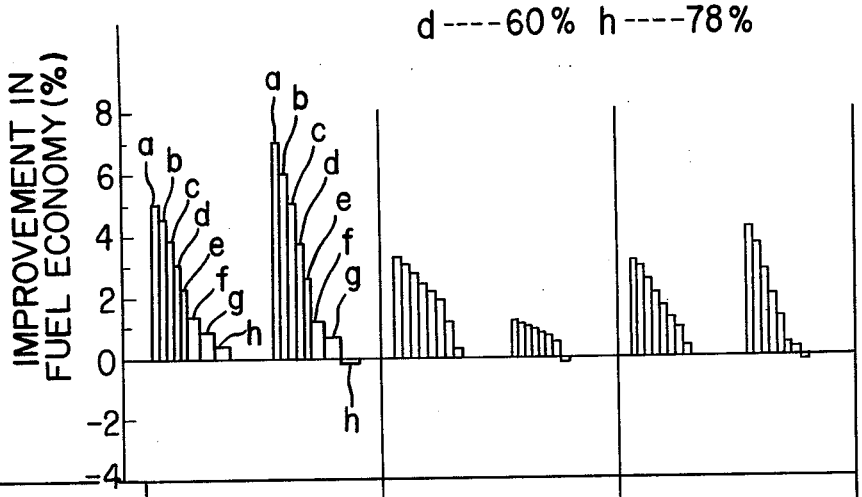
FIG. 8 is a chart showing the effects of the critical area ratio on the fuel consumption of the engine.

In order to confirm the effects of the present invention, tests have been made using corner seals of various critical area ratios and the results are shown in FIG. 8. In the tests, use was made of a two rotor type rotary piston engine having a displacement of 615 cc for each working chamber and a rated power of 135 PS at 6500 rpm. The engine was operated with a constant ignition timing under the cooling water temperature of 90° C. and the lubricant temperature of 80° C. The tests were made under the engine speed of 1000 rpm with the mean effective pressure of 1.5 and 5.5 Kg/cm$^2$, under the engine speed of 1500 rpm with the mean effective pressure of 1.5 and 5.5 Kg/cm$^2$, and under the engine speed of 2000 rpm with the mean effective pressure of 1.5 and 6.5 Kg/cm$^2$. The test results are shown in terms of percentage improvement of fuel consumption with respect to the test result which was obtained in an engine equipped with corner seals having no end recesses.

In FIG. 8, it will be noted that with the critical area ratio of 75% or below an improvement in fuel consumption can be obtained, however, with the critical area ratio of 78%, there is almost no practical improvement.

Figure 9:
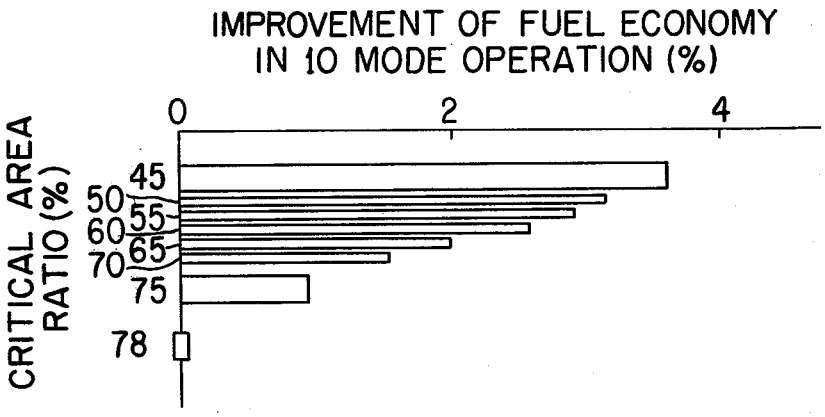
FIG. 9 is a diagram further showing the effects of the critical area on the fuel consumption; and, FIG. 10 is a plan view of a side housing specifically showing the locations where the side housing was inspected for scores.

FIG. 9 shows test results under the 10 mode operation in Japanese standard test procedure. It will be noted herein that an appreciable improvement in fuel consumption can be obtained with the critical area ratio of 75% and below but there is substantially no improvement with the ratio of 78%.

Figure 10:
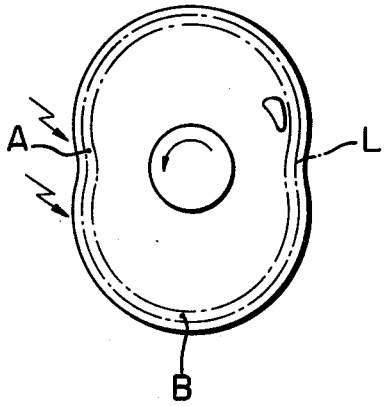

Tests have further been made with smaller critical area ratios and the side housings were subjected to inspections for scores on the inner side walls particularly at the areas designated by the references A and B in FIG. 10. In the test, the engine was operated with repeated cycles of operating it under a wide open throttle at 6000 rpm for three seconds and then operating under a closed throttle at 1500 rpm. After 60000 cycles of operation, the scores on the side housing were measured. The results are shown in Table I.

TABLE I

| CRITICAL AREA RATIO (%) | SCORES IN SIDEHOUSING MAXIMUM DEPTH (μ) LOCATION A SAMPLES I | II | III | LOCATION B SAMPLES I | II | III | ACCEPTABILITY |
|---|---|---|---|---|---|---|---|
| 25 | 83 | 63 | 75 | 12 | 13 | 10 | NO |
| 30 | 55 | 60 | 35 | 23 | 12 | 17 | NO |
| 38 | 45 | 35 | 24 | 15 | 20 | 0 | NO |
| 40 | 45 | 30 | 40 | 0 | 18 | 10 | NO |
| 45 | 15 | 8 | 13 | 0 | 0 | 0 | YES |
| 50 | 13 | 13 | 9 | 0 | 0 | 0 | YES |
| 55 | 3 | 7 | 9 | 0 | 0 | 0 | YES |
| 60 | 9 | 5 | 5 | 0 | 0 | 0 | YES |
| 65 | 12 | 5 | 4 | 0 | 0 | 0 | YES |
| 70 | 6 | 5 | 12 | 0 | 0 | 0 | YES |
| 75 | 5 | 8 | 3 | 0 | 0 | 0 | YES |

In the table, it will be noted that the maximum depth of the score is increased as the critical area ratio is decreased. With the area ratio smaller than 45%, the scores are so significant that the corner seal cannot be practically used.

Further tests have been made to find out the effects of the radial dimension or width of the annular sliding surface 4. In the tests, the engine was operated with the quantity of lubricant which is smaller than usual under the wide open throttle at the engine speed of 7000rpm, the lubricant temperature of 120° C. and the cooling water temperature of 100° C. The results are shown in Table II in terms of the number of occurence of scores in a predetermined number of tests.

TABLE II

| | NUMBER OF OCCURRENCE OF SCORES 45% | 50% | 60% | 70% | 75% |
|---|---|---|---|---|---|
| 0.8 mm | 12/12 | 12/12 | 12/12 | 12/12 | 12/12 |
| 1.0 | 2/12 | 2/12 | 0/12 | 0/12 | 0/12 |
| 1.2 | 0/12 | 0/12 | 0/12 | 0/12 | 0/12 |

In the table, it will be noted that, under the relatively severe test conditions, scores are produced with the radial dimension or width of the sliding surface 4 of less than 1.0mm so that it is usually required to have the sliding surface width not less than 1.0mm. It should be noted, however, that in the corner seal as shown in FIG. 4 the smallest width $W_1$ of the sliding surface 4 may be as small as 0.8mm provided that the width $W_2$ is 1.2mm.

The present invention has thus been shown and described with reference to preferable embodiments and examples, however, it should be noted that the invention is in no way limited to the details of the illustrated structures but changes and modifications may be made without departing from the scope of the appended claims.

I claim:

1. Rotary piston engine comprising a casing having an inner peripheral wall and a pair of inner side walls; a rotor disposed in said casing and having apex portions adapted to be slidably engaged with said inner peripheral wall of the casing, said rotor having a pair of side surfaces opposing to said inner side walls of the casing; said rotor having recesses in the vicinity of the apex portions in each of the side surfaces; and a corner seal received in each of the recesses and having an outer end adapted to be brought into sliding contact with one of the inner side walls of the casing at least under the influence of gas pressure introduced into said recess, said corner seal being formed at the outer end with a second recess leaving a sliding end surface on said outer end of the corner seal, said sliding end surface having an area between 45 and 75% of a sum of the area of the sliding surface and the area of the second recess, said corner seal having a groove for receiving an end of an apex seal and providing means for introducing gas pressure into the second recess, said corner seal further having a cylindrical outer periphery and said second recess being of a circular shape so that the sliding surface is formed in an annular configuration, said corner seal further having an axial bore contiguous with said groove and being located so as to locally decrease the radial dimension of the sliding surface.

2. Rotary piston engine in accordance with claim 1 in which said annular sliding surface has a nominal radial dimension of 1.2mm and a minimum radial dimension of 0.8mm in the area where the axial bore is located.

3. Rotary piston engine comprising a casing having an inner peripheral wall and a pair of inner side walls; a rotor disposed in said casing and having apex portions adapted to be slidably engaged with said inner peripheral wall of said casing, said rotor having a pair of side surfaces opposing to said inner side walls of said casing, said rotor having recesses in the vicinity of the apex portions in each of the side surfaces; and a corner seal received in each of the recesses and having, on an outer end, a sliding surface adapted to be brought into sliding contact with one of said inner side walls of said casing at least under the influence of gas pressure introduced into said recess, said corner seal having a second recess for introducing gas pressure therein, an axial groove for receiving an end of an apex seal, an axial bore for introducing gas pressure into said second recess and a cylindrical outer periphery, said second recess being found at the outer end of said corner seal and being of circular shape and being co-axial with said outer periphery of said corner seal, said bore being contiguous with said groove and being eccentrically located with respect to the said outer periphery of said corner seal, said sliding surface having an area between 45 and 75% of the sum of the area of the sliding surface and the area of said second recess.

* * * * *